United States Patent [19]

Bhat

[11] Patent Number: 4,809,744

[45] Date of Patent: Mar. 7, 1989

[54] UNIFORM FLUID DISTRIBUTION SYSTEM

[75] Inventor: Dinesh Bhat, Richmond, Va.

[73] Assignee: James River Corporation, Richmond, Va.

[21] Appl. No.: 105,572

[22] Filed: Oct. 8, 1987

[51] Int. Cl.[4] ..... B05B 1/14

[52] U.S. Cl. ..... 137/561 A; 239/553.3; 239/566

[58] Field of Search ..... 137/561 A, 561 R; 239/553, 553.3, 566; 405/44

[56] References Cited

U.S. PATENT DOCUMENTS

| | | | |
|---|---|---|---|
| 1,241,032 | 9/1917 | Schneider | 239/553.3 X |
| 2,364,058 | 12/1944 | Burk et al. | 137/561 A |
| 3,531,053 | 9/1970 | Miller et al. | 239/553.3 |
| 3,650,292 | 3/1972 | Platz et al. | 137/561 A |
| 3,777,987 | 12/1973 | Allport | 239/553.3 X |
| 3,850,792 | 11/1974 | Pennington | 239/553.3 X |

*Primary Examiner*—John Rivell

*Attorney, Agent, or Firm*—Burns, Doane, Swecker & Mathis

[57] ABSTRACT

Provided is a distribution system for the uniform distribution of fluids. The system comprises a conduit means which has an inlet for supplying fluid under pressure to the interior of the conduit means. Outlet means are distributed along the length of the conduit for lateral discharge of the fluid from the conduit, and means for increasing the interior surface roughness of the conduit, such as a stainless steel screen, is attached to the inner surface of the conduit opposite the outlet means. The resulting distribution system achieves a uniform distribution of fluid easily and inexpensively.

12 Claims, 1 Drawing Sheet

UNIFORM FLUID DISTRIBUTION SYSTEM

BACKGROUND OF THE INVENTION

1. Field of the Invention

The present invention relates to the uniform distribution of fluids. More particularly, the present invention relates to a distribution system for the uniform distribution of fluids.

2. Description of the Prior Art

It is known to design a fluid conduit having a series of outlets along its length in a manner such that the pressure losses due to friction and the pressure gains due to deceleration offset each other to give a substantially uniform pressure and velocity at each of the conduit outlets. See, e.g., Keller, The Manifold Problem, Journal of Applied Mechanics, March 1949, pages 77–85.

For example, in a conduit having a constant diameter and outlets of uniform size and spacing, the ratio of active length of the manifold to the diameter thereof (L/D) and the ratio of the sum of the outlet areas to the cross-sectional area of the manifold (area ratio) may be proportioned to give a substantially constant pressure along the active length of the conduit. For a smooth steel pipe delivering steam, an L/D ratio of approximately 100 and an area ratio of approximately 1 have been found to give this result. See, for example, U.S. Pat. No. 3,531,053. Of course, the different frictional characteristics of different materials may require some deviation from these values.

Where only the cross-sectional area of the conduit need be uniform, the size and/or spacing of the outlets may be varied to give uniform pressure at each of the conduit outlets. Conversely, where the size and spacing of the outlets must be uniform, the cross-sectional area of the conduit may be varied so that the friction losses and deceleration gains balance each other and result in uniform pressures along the conduit length. However, in many installations, the length and diameter of the conduit and the size and spacing of its outlets will be governed by factors other than the theoretical design considerations necessary to obtain uniform outlet pressures. Consider, for example, a process where it is desired to apply a uniform blanket of steam at some particular volume and velocity to a continuously moving web of material such as paper or the like. This might be done to change its surface characteristics, modify a previously applied coating, etc. The width of the web to be treated would determine the minimum active length of the conduit. The spacing of the outlets would be determined by the desired heat transfer characteristics of the system, while the desired volume and outlet velocity of the steam would influence the diameter of the conduit and size of the outlets. Yet, the need for a uniform distribution system is great. Thus, various attempts have been made to achieve a uniform distribution of fluids.

It will be apparent that with so many of the conduit dimensions influenced by the specific installation in which it is to be used, it will often be impractical, if not impossible, to dimension the conduit to give equal pressures at each of its outlets. Yet, the need for a uniform distribution system is great. Thus, various attempts have been made to achieve a uniform distribution of fluids.

For example, it is known to use a feed conduit or manifold having a series of outlets along its length to feed fluid to a second conduit, which acts as a distribution chamber. Apparatus of this type is shown in U.S. Pat. Nos. 1,031,960; 1,642,154; 1,997,651; 2,809,867; and 3,097,994. Moreover, U.S. Pat. No. 3,531,053 discloses a steam distribution chamber for applying a uniform blanket of steam to a moving web of paper or the like which utilizes a feed manifold hydrodynamically designed to give uniform fluid pressures and velocities at each of its outlets.

While it is known to specifically design manifolds for the uniform distribution of fluids, such designs are often expensive and quite difficult. Thus, the search for a simple and inexpensive system for providing uniform fluid distribution has been continuously on-going. Moreover, a technique for rendering the distribution of fluids uniform through a manifold in a facile manner, and in a manner which could be applied to any manifold, i.e., not only conduits or manifolds specifically designed for the uniform distribution of fluids, would be most welcome to the art.

Accordingly, it is an object of the present invention to provide a novel system for the uniform distribution of fluids.

Another object of the present invention is to provide an inexpensive and easily constructed system for the uniform distribution of fluids.

These and other objects, as well as the scope, nature and utilization of the invention, will be apparent to those skilled in the art from the following description and the appended claims.

SUMMARY OF THE INVENTION

In accordance With the foregoing objectives, provided herewith is a distribution system for fluids comprising:

(a) conduit means;

(b) inlet means for supplying fluid under pressure to the interior of said conduit means;

(c) conduit outlet means distributed along the length of the conduit for laterally discharging the fluid from the conduit; and (d) means for increasing the interior surface roughness of the conduit sufficiently to result in the uniform distribution of fluid through the conduit outlet means.

In a preferred embodiment, the means for increasing the interior surface roughness of the conduit is a screen attached to the inner surface of the conduit opposite the outlet means.

In a more specific embodiment of the present invention, there is provided a manifold for the uniform distribution of steam, comprising:

(a) a manifold with inlet means for supplying steam under pressure to the interior of the manifold;

(b) outlet means distributed along the length of the manifold for lateral discharge of the steam; and (c) a screen attached to the inner surface of the manifold opposite the outlet means such that uniform distribution of steam through the outlet means can be achieved.

DETAILED DESCRIPTION OF THE PREFERRED EMBODIMENTS

The present invention provides a system for the uniform distribution of fluid through a conduit having lateral discharge openings. While the system of the present invention is particularly useful for the distribution of steam onto a moving web, such as a paper web, it can be applied in general to the distribution of any fluid.

The distribution system of the present invention first comprises a conduit means into which the fluid is supplied under pressure. The conduit means can be any conventional means for receiving a fluid to be distributed, e.g., a pipe. It is preferred that the conduit means has a uniform cross-sectional area.

The conduit has outlet means distributed along the length of the conduit for laterally discharging the fluid. These openings or outlets can be spaced uniformly along the length of the conduit means or in distances which increase or decrease along the length of the conduit means. As well, the series of openings might be replaced by a single elongated slot extending throughout the length of the feed conduit.

The uniform distribution of fluid is achieved by providing to the conduit a means for increasing the interior surface roughness of the conduit. This means for increasing the interior surface roughness can be, for example, a screen, such as a stainless steel screen, or a wire mesh, which is attached to the inner surface of the conduit opposite the fluid outlets. If a steel screen or wire mesh is used, it is of sufficient mesh no., thickness and width to provide a roughness sufficient to result in uniform fluid flow along the length of the conduit, and hence uniform distribution of the fluid.

Figure 1:
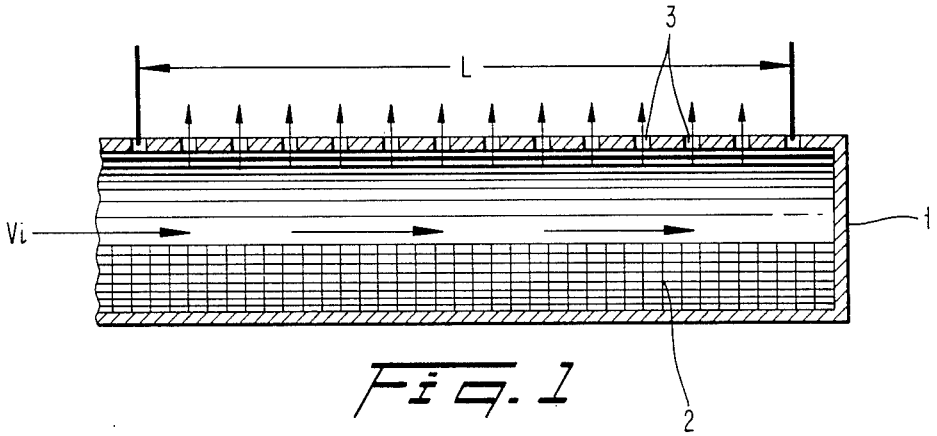
FIG. 1 of the Drawing depicts a side view of a conduit used in the uniform distribution of a fluid in accordance with the present invention.
Figure 2:
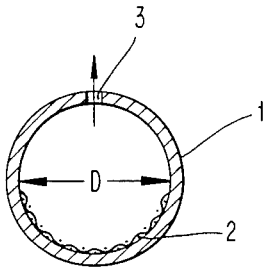
FIG. 2 of the Drawing depicts a cross-sectional view of the conduit of FIG. 1.

Referring to the figures in the Drawing, FIG. 1 depicts a side view of a conduit useful in the practice of the present invention. In the figure, L is the length of the conduit 1 and $V_i$ represents the average fluid velocity of the fluid introduced into the conduit through an inlet means. A screen 2 is attached to the conduit opposite from the outlet means or openings 3. FIG. 2 depicts a cross-section view of the conduit 1, indicating its inner diameter D.

The system of the present invention allows one quite easily and inexpensively to achieve uniform fluid distribution without resorting to expensive tapered headers or large pipe diameter. The system is also widely applicable, e.g., to air headers for melt blowing processes, pipe gas burners and radiant gas burner manifolds, steam nozzles and showers, coating distributors, spray nozzles, etc.

The size of the screen or mesh, and its mesh no., which is preferably used as the means for effecting the increased interior surface roughness, can be easily determined for any particular conduit upon considering the pressure change (Δhp) due to friction and deceleration over the length of the conduit distributor.

For example, in the case of a simple perforated pipe, which is used in many applications such as a gas burner, steam shower, etc., two important factors determine the distribution of flow: (1) kinetic energy and momentum force of the inlet stream, and (2) friction losses in the pipe. As the fluid flows along the length of the manifold or pipe, it loses velocity due to loss of mass through the openings. This loss in velocity in the manifold, in accordance with the Bernonlli principle, increases the fluid pressure. Fluid friction, on the other hand decreases the pressure gain. Uniform fluid distribution can be achieved by proper balance between pressure gain due to deceleration and loss due to friction. The pressure change due to friction and deceleration over the length of the perforated pipe distributor has been shown by theory to be:

$$\Delta hp = \left(\frac{4fL}{3D} - 2\right)\frac{V_i^2}{2gc}$$

(see, Chemical Engineers Handbook, V edition, pages 5–48).

where

Δhp=net loss in head between inlet and closed end of the pipe, ft. of fluid.

f=fanning friction factor, dimensionless.

L=length of pipe, ft.

D=diameter of pipe, ft.

Vi=average fluid velocity, ft/sec.

gc=dimensional constant, 32.17 lb ft/(lb force) $sec^2$.

For uniform flow, Δhp should be close to zero, or $$\frac{4fL}{3D} - 2 = 0.$$

This can be achieved by either adjusting the L/D ratio or f. L/D ratios are difficult to adjust due to practical considerations. By creating turbulent flows, however, f is easily adjusted in order to achieve a uniform flow by adjusting the roughness of the pipe surface. Moreover, once f is adjusted for a particular conduit, with turbulent flow, a uniform flow and distribution of fluid will be realized regardless of the flow rate. This is a major advantage of the present invention The adjustment of f can be done in accordance with the present invention by attaching a ribbon of stainless steel screen of known mesh no., thickness and width, to the inner surface of the conduit. The mesh no., thickness and width of the screen are chosen in order to sufficiently increase the interior roughness of the conduit so as to achieve an f factor which approaches a Δhp of about zero. Minor modifications in order to fine-tune a system can then be quite easily made. These minor modifications can be achieved through altering the screen width, or the amount of screen or wire used. Moreover, once the proper f factor is achieved, in the turbulent flow range, f remains fairly constant for a given roughness factor. So for turbulent flow, Δhp remains close to zero at different inlet velocity conditions, and hence, the screen need not be adjusted for different flow rates.

The present invention is further illustrated by the following example. The details of the following example, however, are in no way meant to be limitative, but rather merely illustrative.

EXAMPLE In a typical application, a perforated pipe distributor was used for applying steam uniformly across a moving web. A schedule no 80, $1\frac{1}{4}''$ steel pipe with a nominal inside diameter of 1.278" and an active length of 82.5" was used. Dimensions of the conduit were determined, and dictated, by the web width and space constraints. In the present instance, heat transfer characteristics dictated that the steam velocity be at least 10,000 fpm through the discharge openings at a minimum flow rate of 200 pounds of steam per hour. Steam velocity and mass flow requirements resulted in 265 outlets of 5/64" diameter spaced 5/16" along the 82.5" active length. From the above data, the following conduit characteristics were calculated as follows:

Active length $L = 82.5$ in.

Inside diameter $D = 1.278$ in. $= 0.1065$ ft.

$$L/D \text{ ratio} = \frac{82.5}{1.278} = 65$$

$$\text{Inside area of cross section} = 1.28 \text{ sq. inches} = 0.00891 \text{ sq. ft.}$$

$$\text{sum of areas of all discharge outlets} = \frac{\pi \times (\text{diameter})^2}{4} \times 265 = \frac{\pi \times (5/64)^2}{4} \times 265 = 1.27 \text{ sq. inches}$$

$$\text{Area Ratio} = \frac{\text{sum of areas of all discharge outlets}}{\text{inside area of cross section}} = \frac{1.27}{1.28} \approx 1.0$$

Reynolds number at 200 lb/hr of steam:

$$RE = \frac{DG}{\mu}$$

$$G = \text{mass velocity} = \frac{\text{mass flow rate}}{\text{inside area of cross section,}} = \frac{200}{0.00891} = 22{,}500 \text{ lb/hr sq. ft.;}$$

$$\text{viscosity of steam at } 212^\circ \text{ F.} = 0.0125 \text{ cps} = 0.0303 \text{ lb/ft. hr}$$

$$Re = \frac{DG}{\mu} = \frac{0.1065 \times 22{,}500}{0.0303} = 79000$$

The foregoing conduit parameters show that the L/D ratio is significantly different than the 100 required for uniform flow at an area ratio equal to 1.0. The Reynolds number value for the conduit is significantly larger than the 10,000 required for fully turbulent flow, hence, the flow is turbulent. Accordingly, although the flow of steam through the perforated pipe is turbulent, a uniform distribution of steam would not be expected.

Figure 3:
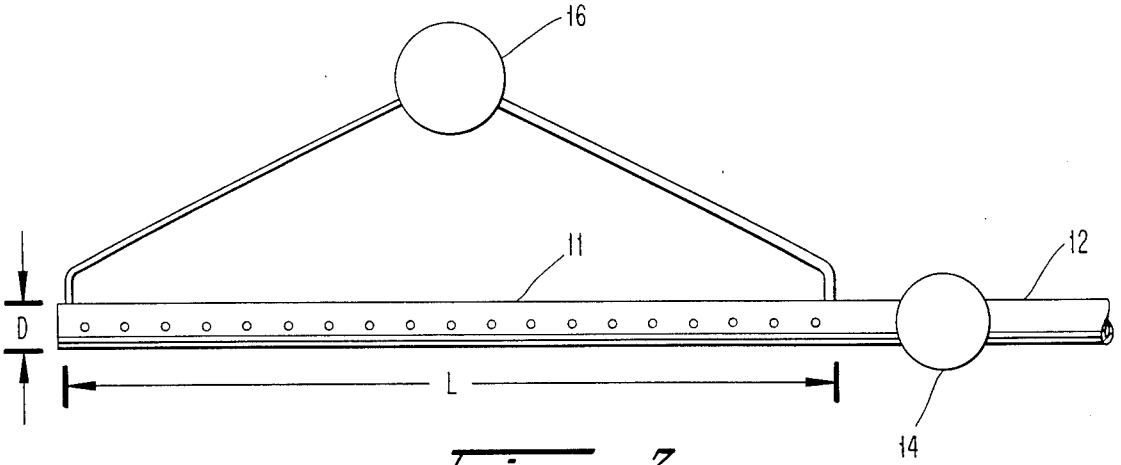
FIG. 3 of the Drawing depicts an experimental set-up used to illustrate the present invention in the Example.

An experimental setup as shown in FIG. 3 was built using the above-described perforated pipe distributor to check the distribution of steam. As seen in FIG. 3, the conduit 11 tested for uniform flow was connected to a fluid supply line 12 through a flow meter 14. Pressure difference between dead end and supply end was measured by means of a differential pressure gauge 16 in inches of water column. Flow distribution is uniform if the differential pressure is zero.

The conduit was first tested for flow distribution with no screen attached to the inner surface. Differential pressure greater than 1" water column was recorded as significant and indicated as (+ve). The unmodified conduit showed a non-uniform distribution of steam at various steam flow rates.

To correct the problem, a 316 stainless steel wire screen (18 mesh no; 0.017 inch wire diameter) was attached to the inner surface of the conduit to approximately attain the desired roughness factor. The width of the screen strip was then slightly adjusted by trial and error technique to give zero differential pressure at a given flow rate. A $1\frac{3}{8}''$ width × 82.5" long piece of wire screen gave zero differential pressure at 200 lb/hr of steam flow rate. The experiment was repeated at different flow rates, with zero differential pressure being realized without the need for further adjustment of the screen strip. The results are presented in Table I below.

Table I clearly shows that uniform fluid distribution was achieved not only at one given flow rate, but also at different flow rates, through the use of the present invention.

TABLE I

| Steam Flow Rate lb/hr | Conduit Condition | Differential Pressure Between Dead End and Supply End |
|---|---|---|
| 200 | no screen | +ve* |
| 300 | no screen | +ve |
| 400 | no screen | +ve |
| 200 | with screen | 0 |
| 300 | with screen | 0 |
| 400 | with screen | 0 |

*+ve means pressure greater than 1" $H_2O$

Although the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A distribution system for fluids comprising:

(a) conduit means;

(b) inlet means for supplying fluid under pressure to the interior of said conduit means;

(c) conduit outlet means distributed along the length of the conduit for laterally discharging the fluid from the conduit; and (d) means for increasing the interior surface roughness of the conduit sufficiently to result in the uniform distribution of fluid through the conduit outlet means when the fluid is passed through the conduit under turbulent flow conditions, which means is positioned on the inner surface of the conduit opposite the conduit outlet means such that a fluid passing through the conduit does not have to pass in contact with said means immediately prior to passing through the conduit outlet means.

2. The distribution system of claim 1, wherein the means for increasing the interior surface roughness is a screen attached to the inner surface of the conduit opposite the conduit outlet means, such that a fluid passing through the conduit does not have to pass through the screen immediately prior to passing through the outlet means.

3. The distribution system of claim 2, wherein the screen is a stainless steel screen.

4. The distribution system of claim 2, wherein the conduit outlet means are uniformly distributed along the length of the conduit.

5. The distribution system of claim 2, wherein the conduit means is of substantially uniform cross-sectional area.

6. The distribution system of claim 2, wherein the conduit means is a pipe distributor.

7. A manifold for the uniform distribution of steam, comprising:

(a) a manifold with inlet means for supplying steam under pressure to the interior of the manifold;

(b) outlet means distributed along the length of the manifold for lateral discharge of the steam; and (c) a screen attached to the inner surface of the manifold opposite the outlet means, such that the steam passing through the manifold does not have to pass through the screen immediately prior to passing through the outlet means, with the screen being of sufficient size and mesh no. such that the interior surface roughness of the conduit is increased sufficiently to achieve a uniform distribution of steam through the outlet means when the steam is passed through the manifold under turbulent flow conditions.

8. The manifold of claim 7, wherein the screen is a stainless steel screen.

9. The manifold of claim 8, wherein the manifold is of substantially uniform cross-sectional area.

10. A process for the uniform distribution of a fluid which is passed through a conduit, comprising the steps of (a) providing a conduit having outlet means distributed along its length for laterally discharging the fluid from the conduit, said conduit comprising means for increasing its interior surface roughness sufficiently to result in the uniform distribution of fluid through the outlet means, and (b) providing a fluid to the conduit under conditions of turbulent flow.

11. The method of claim 10, wherein the means for increasing interior surface roughness of the conduit provided is a screen attached to the inner surface of the conduit opposite the outlet means, such that the fluid does not have to pass through the screen immediately prior to passing through the conduit outlet means.

12. The method of claim 11, wherein the screen is a stainless steel screen.

* * * * *